US008096072B2

(12) United States Patent
Blanchard

(10) Patent No.: US 8,096,072 B2
(45) Date of Patent: Jan. 17, 2012

(54) METHOD AND APPARATUS TO PREVENT GHOSTING IN A RECYCLED ROAD SIGN

(75) Inventor: Jay Blanchard, Prior Lake, MN (US)

(73) Assignee: Safety Signs, Lakeville, MN (US)

( * ) Notice: Subject to any disclaimer, the term of this patent is extended or adjusted under 35 U.S.C. 154(b) by 0 days.

(21) Appl. No.: 12/774,443

(22) Filed: May 5, 2010

(65) Prior Publication Data

US 2010/0208345 A1 Aug. 19, 2010

Related U.S. Application Data

(63) Continuation of application No. 11/782,386, filed on Jul. 24, 2007, now Pat. No. 7,716,862.

(60) Provisional application No. 60/820,188, filed on Jul. 24, 2006.

(51) Int. Cl.
*G09F 7/00* (2006.01)

(52) U.S. Cl. ..... 40/612; 40/594

(58) Field of Classification Search ..... 40/594, 40/612, 630, 600

See application file for complete search history.

(56) References Cited

U.S. PATENT DOCUMENTS

| | | | | |
|---|---|---|---|---|
| 2,052,771 | A | 9/1936 | Johnson | |
| 2,549,419 | A | 4/1951 | Callahan | |
| 2,621,431 | A * | 12/1952 | Rericker | 40/612 |
| 4,507,888 | A * | 4/1985 | Robinson et al. | 40/621 |
| 4,793,082 | A | 12/1988 | Petrick et al. | |
| 5,050,327 | A | 9/1991 | Woltman | |
| 5,268,775 | A | 12/1993 | Zeidler | |
| 5,398,112 | A | 3/1995 | Ai et al. | |
| 5,415,911 | A | 5/1995 | Zampa et al. | |
| 5,656,360 | A | 8/1997 | Faykish et al. | |
| 5,866,236 | A | 2/1999 | Faykish et al. | |
| 5,959,739 | A | 9/1999 | Green et al. | |
| 6,041,533 | A | 3/2000 | Lemmond, Jr. | |
| 6,134,819 | A | 10/2000 | McClain et al. | |
| 6,217,958 | B1 * | 4/2001 | Blyden et al. | 428/31 |
| 6,652,954 | B2 | 11/2003 | Nielsen et al. | |
| 7,411,681 | B2 | 8/2008 | Retterath et al. | |
| 7,716,862 | B2 | 5/2010 | Blanchard | |
| 2004/0114229 | A1 | 6/2004 | Sakaguchi | |
| 2005/0284011 | A1 * | 12/2005 | Todd | 40/600 |
| 2008/0022573 | A1 | 1/2008 | Blanchard | |

FOREIGN PATENT DOCUMENTS

| | | |
|---|---|---|
| GB | 2400717 | 10/2004 |

* cited by examiner

*Primary Examiner* — Casandra Davis
(74) *Attorney, Agent, or Firm* — Schwegman, Lundberg & Woessner, P.A.

(57) ABSTRACT

One example embodiment disclosed herein includes a sign substrate including a front side and a back side, a reflective traffic sign layer to reflect a light to display a traffic message to traffic, the reflective traffic sign layer coupled to the front side of the sign substrate, a light blocking layer masking the reflective traffic sign layer to prevent the light from reflecting a ghost image of the message through the light blocking layer to the traffic and a replacement reflective traffic sign layer disposed on top of the light blocking layer, the replacement reflective traffic sign layer to reflect the light to display a reflected replacement message to the traffic.

9 Claims, 2 Drawing Sheets

METHOD AND APPARATUS TO PREVENT GHOSTING IN A RECYCLED ROAD SIGN

CROSS REFERENCE TO RELATED APPLICATION

This application is a continuation of U.S. application Ser. No. 11/782,386, filed Jul. 24, 2007 and issued on May 18, 2010 as U.S. Pat. No. 7,716,862, which claims priority to U.S. Provisional Application Ser. No. 60/820,188, filed Jul. 24, 2006, which applications are hereby incorporated by reference in their entirety.

TECHNICAL FIELD

The inventive subject matter relates generally to the field of signs, and more particularly to road signs.

BACKGROUND

Traffic signs are found on virtually every road in the United States and in other developed countries. At one point or another many traffic signs need replacement for example due to fading or becoming obsolete. Replacing the entire structure supporting or holding the road signs is expensive. Currently, when old signs are replaced they are sometimes taken down and discarded. Or, some may be stripped of their old legend and a new legend is applied. The new sign is provided on a new sign blank and installed.

SUMMARY

According to one example embodiment disclosed herein includes a system and method for refurbishing road signs. These and various other example embodiments of the inventive subject matter are disclosed herein.

DETAILED DESCRIPTION

Figure 1:
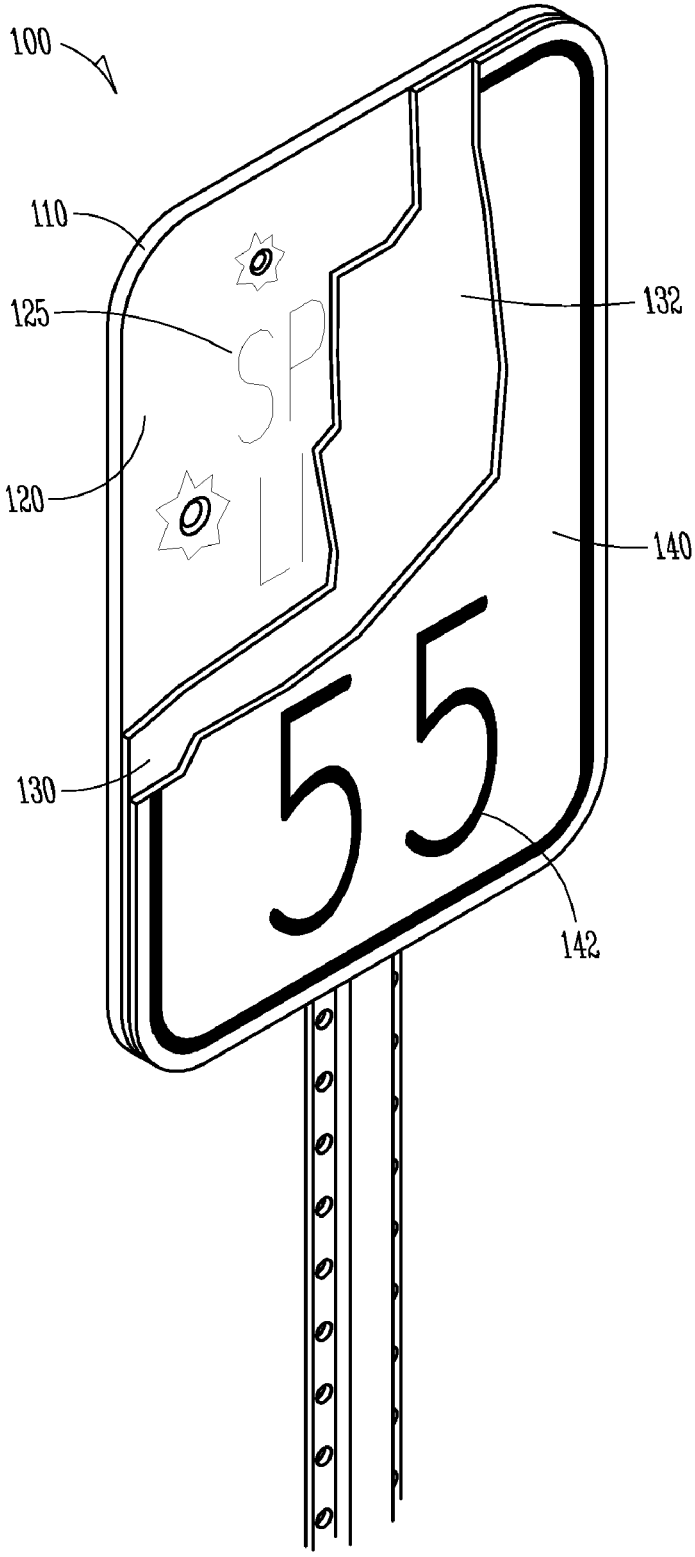
FIG. 1 illustrates a refurbished traffic sign, according to an example.

In the following detailed description of the invention, reference is made to the accompanying drawings that form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural or other changes may be made without departing from the scope of the present invention.

Referring now to FIG. 1 there is illustrated an enlarged cross-sectional view of a first example embodiment of a refurbished traffic sign 100 according to one example embodiment of the inventive subject matter. Refurbished sign 100 includes a structural substrate 110, such as a metal, fiberglass, composite or other rigid material. According to one example embodiment, the metal may be aluminum or steel or an alloy or two or more metals. A first traffic sign face layer 120 is disposed over substrate 110 and includes a traffic sign message, such as a warning, speed limit, caution or merge message, with a reflective surface or tape on top of which a message or legend is disposed. Layer 120 may be, for example, a laminate that is adhered to the substrate 110. Such laminates may be obtained, for example, from 3M Corporation and Avery Dennison, Inc. Alternatively, Layer 120 may be painted on the substrate 110.

Disposed on top of layer 120 is a masking layer 130. Masking layer 130 may be aluminum, steel, plastic, fiberglass, wood or any other material that will stop the transmission of light, to prevent it from reaching the sign message or reflective backing layer thereby creating potential ghosting or other evidence of the covered original sign message on layer 120 during use. In another example embodiment, masking layer 130 may be formed from or include a metallic film, such as a metallic film or foil, such as aluminum foil or a zinc coated foil, that effectively prevents light from penetrating the masking layer 130 and reaching the sign message or reflective backing layer. In another example embodiment, the masking layer may take the form of a laminate film or laminate sheeting. In another embodiment, the layer 130 may be applied as a sprayed-on or brushed-on liquid that cures on the layer 120 to provide the desired masking effect. Such liquid may include, for example, metallic components to accomplish the desired effect of blocking light.

In one embodiment, the outer surface 132 of layer 130 may allow adhesion of a new sign face 140 including a new traffic sign message 142 thereto. In one example the new sign face 140 is disposed on top of the masking layer 130. In another embodiment, the new sign face 141 is placed on the back-side of substrate 110, and the masking layer is oriented as the back of the sign in use. According to still another example embodiment, the new sign face 140 may be of the same type as the old sign face 120.

Figure 2:
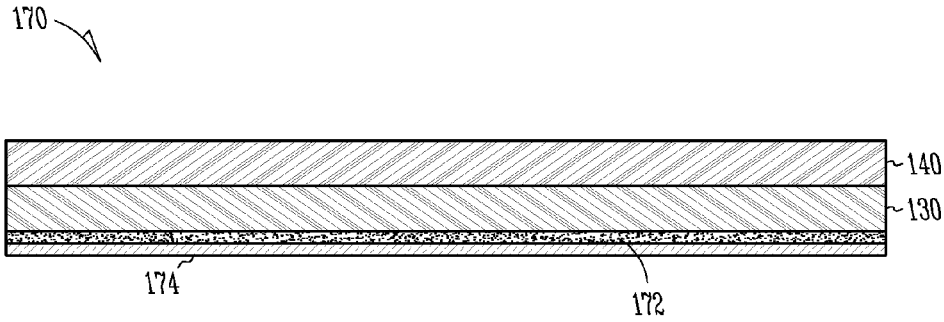
FIG. 2 illustrates a cross section of a sign, according to an example.
Figure 3:
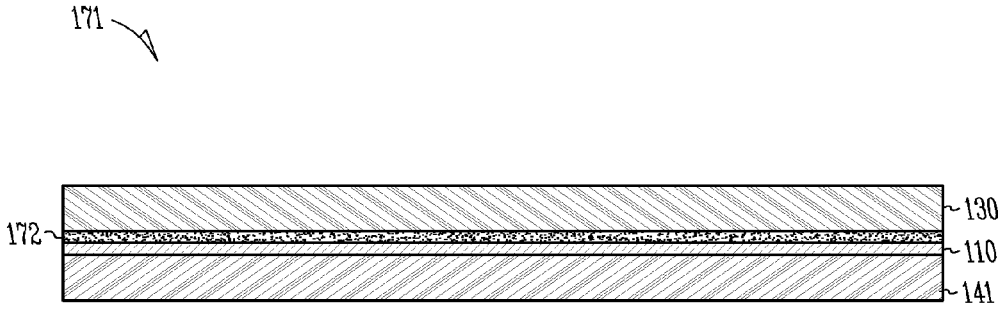
FIG. 3 illustrates a substrate with a masking layer and a sign face, according to some examples.

According to one example embodiment illustrated in FIG. 2, the masking layer 130 and sign face 140 may be bonded, fused, adhered or otherwise fixed to one another to form an integral unit 170 taking the form of a sheet or laminate. In this embodiment, the outward surface of masking layer 130 may include an adhesive layer 172 that may be covered with a non-stick removable backing 174 that may be removed to expose the adhesive layer 172, which may then be used to stick or adhere unit 170 to an old sign face.

According to still another example embodiment, the masking layer 130 may be applied in the field, or in a shop. Further, adhesive used to apply the masking layer 130 may be pre-applied to a laminate or other membrane used for layer 130 and be sold and shipped together with the laminate or membrane, or may be applied to the back of the laminate or membrane used for layer 130 just prior to application to the old sign face 120. According to another example embodiment, the layer 130 may provide at least some structural self-support that is adapted to cover imperfections in the old sign face 120, such as small holes, cuts or dents. Accordingly, the described structure and process may facilitate sign updates in the field at or near the site of where the old sign was deployed. Accordingly, the method and system described herein allows for recycling of old signs, such that the new sign performs as well as the old sign.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A method comprising:

uninstalling a reflective traffic sign;

laminating a light blocking layer onto a reflective portion of the reflective traffic sign;

preventing light from reflecting from the reflective portion with the light blocking layer;

and laminating a replacement traffic sign layer onto the light blocking reflective layer, wherein laminating the light blocking layer onto the reflective portion of the reflective traffic sign includes adhering the light blocking layer onto the reflective portion of the reflective traffic sign, and further comprising:

pre-applying an adhesive to the light blocking layer; and peeling off a release layer from the light blocking layer prior to adhering the light blocking layer onto the reflective portion of the reflective traffic sign.

2. The method of claim 1, wherein laminating the replacement traffic sign layer onto the light blocking reflective layer includes fusing the replacement traffic sign layer onto the light blocking reflective layer.

3. The method of claim 2, wherein fusing the replacement traffic sign layer onto the light blocking reflective layer occurs at a field location.

4. The method of claim 1, wherein uninstalling the reflective traffic sign includes uninstalling the reflective traffic sign from a field location, wherein laminating the light blocking layer onto the reflective portion of the reflective traffic sign includes laminating the light blocking layer onto the reflective portion of the reflective traffic sign at the field location, and wherein laminating the replacement traffic sign layer onto the light blocking reflective layer occurs at the field location.

5. The method of claim 1, wherein laminating the replacement traffic sign layer onto the light blocking reflective layer includes adhering the replacement traffic sign layer onto the light blocking reflective layer with an adhesive, and further comprising:

pre-applying the adhesive to the replacement traffic sign layer; and peeling off a release layer from the replacement traffic sign layer prior to adhering the replacement traffic sign layer onto the light blocking reflective layer.

6. A method comprising:

uninstalling a reflective traffic sign;

laminating a light blocking layer onto a reflective portion of the reflective traffic sign;

preventing light from reflecting from the reflective portion with the light blocking layer; and laminating a replacement traffic sign layer onto the light blocking reflective layer, wherein laminating the replacement traffic sign layer onto the light blocking reflective layer includes adhering the replacement traffic sign layer onto the light blocking reflective layer with an adhesive;

pre-applying the adhesive to the replacement traffic sign layer; and peeling off a release from the replacement traffic sign layer prior to adhering the replacement traffic sign layer onto the light blocking reflective layer.

7. The method of claim 6, wherein laminating the replacement traffic sign layer onto the light blocking reflective layer includes fusing the replacement traffic sign layer onto the light blocking reflective layer.

8. The method of claim 7, wherein fusing the replacement traffic sign layer onto the light blocking reflective layer occurs at a field location.

9. The method of claim 6, wherein uninstalling the reflective traffic sign includes uninstalling the reflective traffic sign from a field location, wherein laminating the light blocking layer onto a reflective portion of the reflective traffic sign includes laminating the light blocking layer onto the reflective portion of the reflective traffic sign at the field location, and wherein laminating the replacement traffic sign layer onto the light blocking reflective layer occurs at the field location.

* * * * *